US008417369B2

(12) United States Patent
Honegger et al.

(10) Patent No.: US 8,417,369 B2
(45) Date of Patent: Apr. 9, 2013

(54) DEVICE FOR MACHINING CONTINUOUSLY SUCCESSIVELY TRANSPORTED, FLAT OBJECTS OR AN ALMOST ENDLESS WEB OF MATERIAL

(75) Inventors: Werner Honegger, Bach (CH); Roman Dax, Baretswil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 12/305,274

(22) PCT Filed: Mar. 8, 2007

(86) PCT No.: PCT/CH2007/000130

§ 371 (c)(1),
(2), (4) Date: Jan. 20, 2009

(87) PCT Pub. No.: WO2007/147269

PCT Pub. Date: Dec. 27, 2007

(65) Prior Publication Data

US 2009/0228140 A1 Sep. 10, 2009

(30) Foreign Application Priority Data

Jun. 21, 2006 (CH) ..... 1001/06

(51) Int. Cl.
*G06F 19/00* (2011.01)

(52) U.S. Cl.
USPC ..... 700/122; 700/167

(58) Field of Classification Search ..... 700/122, 700/167; 83/508.1, 614
See application file for complete search history.

(56) References Cited

U.S. PATENT DOCUMENTS

| | | | | |
|---|---|---|---|---|
| 4,073,116 | A | 2/1978 | Glvoer | |
| 4,300,977 | A * | 11/1981 | Schulze | 156/515 |
| 5,755,923 | A | 5/1998 | Kleinhenz et al. | |
| 6,092,452 | A * | 7/2000 | Adami | 83/428 |
| 6,481,188 | B1 | 11/2002 | Graham et al. | |
| 7,320,206 | B2 * | 1/2008 | Honegger | 53/553 |
| 7,603,188 | B2 * | 10/2009 | Maeda | 700/63 |
| 7,658,053 | B2 * | 2/2010 | Honegger | 53/450 |
| 7,757,461 | B2 * | 7/2010 | Honegger | 53/447 |
| 2004/0177737 | A1 * | 9/2004 | Adami | 83/508.1 |

FOREIGN PATENT DOCUMENTS

| | | |
|---|---|---|
| DE | 2651131 A1 | 5/1977 |
| EP | 0712782 A1 | 5/1996 |

(Continued)

OTHER PUBLICATIONS

Helwig, Apparatus for Processing Continuously Fed Elongate Material, Internation Publication No. WO 00/35757, International Application No. PCT/IB99/02097.*

*Primary Examiner* — Mohammad Ali
*Assistant Examiner* — Nathan Laughlin
(74) *Attorney, Agent, or Firm* — Rankin, Hill & Clark LLP

(57) ABSTRACT

A device for processing objects which are conveyed one after another in a continuous manner, or a quasi endless material web, includes tools revolving on a revolving path. In one variant of the device, the tools are controllably pivotable relative to the revolving path in a manner such that their pivot position is adapted in a controlled manner to the objects to be processed or the material web, independently of an orientation of the revolving path. In a further variant of the device, the device includes at least one drive, which are controllable in a manner such that the tools in groups or individually, may be driven simultaneously at different speeds on the revolving path. This, for example, is realized by way of two drives, wherein each second tool is coupled to the first drive, and the other tools to the second drive.

28 Claims, 6 Drawing Sheets

FOREIGN PATENT DOCUMENTS

| | | | |
|---|---|---|---|
| EP | 0945349 | | 9/1999 |
| EP | 1362790 | A1 | 11/2003 |
| EP | 1362790 | A1 * | 11/2003 |
| GB | 1261179 | | 1/1972 |
| WO | 00/35757 | | 6/2000 |

* cited by examiner

DEVICE FOR MACHINING CONTINUOUSLY SUCCESSIVELY TRANSPORTED, FLAT OBJECTS OR AN ALMOST ENDLESS WEB OF MATERIAL

The invention lies in the field of processing technology, in particular in packaging technology. The device serves for processing flat objects which are conveyed one after another in a continuous manner, or a likewise continuously conveyed, quasi endless material web, wherein a tool acts on each object or on the material web at defined, in particular regular distances, for the processing, and wherein the tool at least during its action on the object or on the material web, is moved with the object or the material web in a manner such that as much as possible, no relative movement parallel to the conveyor direction exists between the tool and the object or the material web. The device in particular serves for the finish packaging of flat objects which are conveyed one after another in a continuous manner, in particular printed products which are tucked into a film web, by way of transversely welding (sealing) the film web between consecutive objects, and severing it as the case may be.

BACKGROUND OF THE INVENTION

1. Field of the Invention

The invention lies in the field of processing technology, in particular in packaging technology, and relates to a device according to the preamble of the independent patent claim. The device serves for processing flat objects which are conveyed one after another in a continuous manner, or a likewise continuously conveyed, quasi endless material web, wherein a tool acts on each object or on the material web at defined, in particular regular distances, for the processing, and wherein the tool at least during its action on the object or on the material web, is moved with the object or the material web in a manner such that as much as possible, no relative movement parallel to the conveyor direction exists between the tool and the object or the material web. The device in particular serves for the finish packaging of flat objects which are conveyed one after another in a continuous manner, in particular printed products which are tucked into a film web, by way of transversely welding (sealing) the film web between consecutive objects, and severing it as the case may be.

2. Description of Related Art

The mentioned transverse welding and severing of the film web is carried out according to the state of the art, for example with a pair of cooperating, synchronously driven tools (welding bar and counter-tool) which extend transversely to the conveyor direction and parallel to the width of the film web, of which one acts on the film web from the above, and one on the film web from below. For this, the two cooperating tools rotate in the opposite direction and synchronously, in a manner such that when they are directed against one another, they may weld and separate the film web. By way of a resilient mounting of the tools and by way of a speed of the tools which is adapted to the conveyor speed, one ensures that a sufficient time interval is available for the welding and separation, during which the relative speed between the distal ends of the tools and the film web is sufficiently small for a welding and separation with no problems. The rotating tools therefore during their action on the film web, are moved at a speed, which is adapted to the conveyor speed of the film web. During their further movement, which after the welding and separation brings them back to the starting point for a further welding and separation, their speed may usually be set in a manner such that the distances of the action on the film web, thus the format of the packages to be created, may be varied. It is also known to stop the rotating movement of the tools, or to suppress their action on the film web with a part of their rotations, when the distances between the transverse weldings to be created, are too large. It is also suggested to provide several pairs of tools, in order to be able to also realise smaller distances between the transverse weldings, wherein all tools revolve synchronously and are distanced regularly to one another.

A device which operates according to the mentioned principle is described, for example, in the publication DE-2651131.

The devices of the mentioned type are greatly limited with respect to the length of the path which is available for the welding and separation of the film web. In other words, this means that, as the case may be, the conveyor speed must be reduced, should a longer acting time be necessary. The devices are likewise limited with regard to the variability of the distances between the transverse welding, wherein these distances, in particular, may not be infinitely small.

The firstly mentioned limitation is likewise remedied in known devices by way of the revolving path of the tools not being effected by a simple rotation (circular path), but by a superposition of a sliding movement parallel to the conveyor direction and a travel movement transverse to the conveyor direction. Such revolving paths are produced, for example, with the help of a crank drive or with a slide which is moved to and fro, on which a separately driven travel device is arranged. Such devices are described, for example, in the publications EP-0712782 or GB-1261179. The second limitation mentioned above is also applied to these devices.

A device for welding a material web with two part devices is known from EP-A 1 362 790. The part devices which are arranged mirror-symmetrically to the material web or its conveyor surface, in each case include two tools, which are resiliently fastened on spokes which are rotatable about a centre and, thus, are moved along a circular revolving path. In the processing region, in each case, a tool of one part device and a counter-tool of the other part device meet one another in a resilient manner, so that a certain processing pressure is exerted, and the revolving path of the actual tools flattens under pressure. The revolving path would be purely circular without a counter-pressure by way of a counter-tool or a rigid conveyor surface. A similar device with tools arranged on a wheel is known from WO00/35757.

These known devices have the advantage that the movement path of the tools, at least in the processing region, is directed largely parallel to the material web or to the objects to be processed, although the tool is moved in a very simple manner along a circular path, specifically by way of it being fastened on a rigid body which is rotatable about an axis, e.g. spokes or on a drive wheel. The straight path in the processing region has advantages, in particular when welding, since the time interval which is available for the processing is increased compared to an only point-like contact. However, one has to accept a relatively large force effect on the tools and counter-tools or the objects or their conveyor surface. This size of this force depends on the position along the movement path, and it is therefore almost always larger than that force which would be necessary for the actual processing. This may lead to quite a large wear of the tools and/or their bearings. With these examples, no defined processing whatsoever is possible without a counter-pressure by a conveyor surface or a counter-tool.

BRIEF SUMMARY OF THE INVENTION

It is the object of the invention, to widen the limitations of the devices according to the state of the art, which serve the same purpose as the device according to the invention. The device according to the invention, amongst other things, should be simple with regard to design, and low in wear. Alternatively or additionally, it should also permit the objects which are conveyed one after the other in a continuous manner or the quasi endless material web, to be processed, even if the path (necessary action time multiplied by the conveyor speed) which is necessary for the processing, is long in particular due to high conveyor speeds and, as the case may be, attains a length which lies in the same magnitude as the distances between the processing, which are to be set up. Despite this, it should not be necessary to mechanically change or set anything with regard to the device and/or to change the conveyor speed, if one is to act on the objects or material web with the device at variable, in particular also, very small distances.

The device according to the invention, as with the devices according to the state of the art which serve the same process, at least on the one side of the conveyor path of the objects or the material web, includes a revolving path on which at least two tools revolve. According to the invention, the tools are pivotable relative to the revolving path in a controlled manner, so that their pivot position is adapted in a controlled manner to the objects to be processed or the material web, independently of an orientation of the revolving path. The revolving path thereby is the path of any point which is moved with the tool and which does not carry out the pivot movement with this. Due to the control of the pivot position, despite a revolving path which as a rule is arcuate, in the processing region, one succeeds in realising a straight path of the active processing elements of the tools, which cooperate with the objects or the material web, without an external force effect, in particular without a counter-force which is exerted by a conveyor surface or a counter-tool. This has the great advantage that one may apply a drive system which is simple with regard to design, e.g. in the form of a wheel or of spokes, on which the tools are fastened. This device may accordingly be realised also in a very space-saving manner.

For setting the pivot positions, the tools are preferably controlled with a stationary cam which cooperates with the tools at least in the processing region, whilst these are moved along the revolving path. The force which acts on the objects or the material web to be processed may be exactly metered by these cams.

The invention is particularly advantageous, if, proceeding from a purely circular movement of the tools, which may be produced in a particularly simple manner by way of rotation of a rigid body, a movement path of the processing elements of the tools cooperating with the objects or the material web, which differs from a circular path, is to be realised. According to the invention, this is effected by way of the circular movement, i.e. the mere rotation of a body, being superimposed with a controlled pivoting movement. The distance to the rotation centre may be varied in a controlled manner by way of this. Instead of a pivot movement, a movement in the radial direction is also conceivable, e.g. in particular a cam-controlled advance and retreat of the tool along a radially running guide rail or guide sleeve.

In a preferred further formation of the invention, at least one carrier element which may be rotated about a rotation centre is present. Moreover, the tools include a lever as well as a processing element which cooperates with the objects or the material path. The levers are pivotably connected at a first lever end at a constant distance to the rotation centre, to the at least one carrier element. The revolving path described above may be identified here by the path of the first lever ends or the articulation points; and the revolving path is accordingly circular. The processing element is attached at a second lever end. The pivot position of the lever relative to the carrier element may be set at least in the processing region, by way of at least one stationary cam. The carrier element, for example, is a spoke or wheel, which is rotatable about the rotation centre, on which several tools may be articulated. The pivotable levers permit the distance of the processing elements to the rotation centre to be changed in a manner controlled by the cam, and thus the production of a flattened path of the processing elements, or even one that is straight over stretches, wherein the orientation of the processing elements in space remains constant within a certain angular range.

In a further advantageous formation of the invention, the processing elements are even coupled to the carrier elements via two levers. By way of this, the processing elements may be moved with two degrees of freedom relative to a purely circular path. The positions of the levers relative to one another and to the carrier element are in each case set independently of one another by way of two cams. By way of this, not only does one succeed in the production of a path of the processing elements which is shaped according to wishes, but also in the setting of an angle of the processing elements relative to their path or to the objects to be processed or to the conveyor surface. For example, by way of this, one may advantageously ensure that the processing element is always orientated perpendicularly to the conveyor surface. This has an advantage, in particular with a welding element.

The processing element is preferably a welding element, e.g. a welding bar. Other functions are however likewise possible, e.g. lettering, perforating, severing. In all cases, the force acting on the objects to be processed or the material web may be limited and kept essentially constant. For this reason, one may make do without a stabilising conveyor surface which is present additional to the material web, for certain applications with which the material web has the necessary loading ability for carrying the objects.

The invention may particularly advantageously be applied with devices with which the tool as a whole is moved along a circular path, which is defined by the rotation of a rigid body, e.g. a spoke or a wheel. One may produce a path of the active regions of the tools which is flatted compared to a circular path, and/or a certain orientation of the tool with regard to the objects to be processed or to the material web, by way of the control of the pivot position.

An application of the invention with tools which are moved along infinitely shaped guide rails has the advantage that here, the orientation of the tools may be set independently of the shape of the movement path.

A device according to the invention is particularly advantageous, with which the tools cooperate with a revolving conveyor surface, e.g. a revolving conveyor belt, as a counter-tool. Alternatively, the counter-tools may also be arranged on a counter-device which is constructed in an analogous manner. In both cases, one succeeds in limiting the force acting on the counter-tool or counter-tools by way of the inventive control of the position of the tools relative to their fixedly defined revolving path. The wear is thus reduced.

According to another aspect of the invention, which may be applied additionally or as an alternative to the control of the tools which is described above, at least two tools are present and are driven independently of one another in a manner such that they may be moved simultaneously along the revolving path with different speeds, thus the distances between consecutive tools may vary during the revolving. Advantageously, more than two tools are provided, which revolve on the same revolving path, wherein all tools are driven independently of one another at least in a limited manner, or wherein groups of tools (e.g. each second tool) are coupled to different drives in a manner such that all tools of a group have the same revolving speed at every point in time, but may differ from the peripheral speed of the tools of other groups.

Due to the independence of the tools, it is possible with the device according to the invention, for two (or even more than two) tools to act on the objects to be processed or on the material web, at the same time, even with different processing speeds and return speeds, which is only possible with the devices according to the state of the art, if the distance between the processing operations corresponds precisely to the distance between the tools. This means that even with a relatively long path which is necessary for the processing (longer processing time or high conveyor speed), it is possible with the device according to the invention to realise relatively small distances between the processing operations, in particular distances which are smaller than the necessary processing path.

The device according to the invention, thus, includes a revolving path, along which at least two tools revolve. The revolving path includes a processing region, in which it advantageously runs parallel to the conveyor direction of the objects to be processed or material web. The revolving path may, however, also be circular, wherein a movement of the distal tool ends parallel to the conveyor direction may be realised in a way and manner known per se, by way of a resilient mounting of the tools, or an individual radial movement of the tools which is superimposed on the circular movement. The tools are firmly coupled to drives which are independent of one another, in groups (e.g. each second tool on the revolving path or in each case one of only two tools), or a drive is arranged along the revolving path, and the tools are coupled to the drive or decoupled from this, in an individual and selective manner.

In a preferred embodiment of the device according to the invention, an even number of tools is provided, wherein each second tool is firmly coupled to a chain drive or belt drive, which for example, is arranged laterally of the conveyor stretch of the objects to be processed or of the material web, and the remaining tools are coupled to the same or similar chain drive or belt drive, which is arranged on the other side of the conveyor stretch. The two drives may be controlled in the same manner as is the case in devices according to the state of the art, specifically with a processing speed which is adapted to the conveyor speed during the processing, and with a return speed which is adapted to the distances between the processing locations which are to be set up, wherein the tools during the return may also be stopped (return speed which is equal to zero). The two drives thus operate in regular, equal cycles and with a phase shift which is adapted to the processing distances.

Of course, it is also possible to replace the chain drives or belt drives with other suitable drives, and to provide more that two drives which are independent of one another, wherein then every third, every fourth etc. tool is firmly coupled in each case to one of the drives.

In a further preferred embodiment of the device according to the invention, one provides a drive, to which all tools are selectively coupled or not. Such a drive is, for example, a drive which is based on the eddy-current principle, from which the tools may be decoupled in a simple manner (e.g. by way of mechanical stopping). In this embodiment, the movement of the tools on the revolving path is not determined by the drive, but also by control means (e.g. a stop at the exit of a buffer stretch), by way of which the tools may be decoupled from the drive or coupled to the drive. Advantageously, the drive runs at the processing speed, wherein the tools, by way of a suitably controlled stop, are buffered directly before the processing region, and a tool is released from the buffer for each processing step.

The drives, by way of whose action the tools revolve on the revolving path, are controlled in a manner such that the tools run into the processing regions in a manner which is synchronised with the objects to be processed. If the objects to be processed are supplied in a precisely cycled manner, or if the material web to be processed, is to be processed at defined, regular distances, then the drives are controlled in a manner such that the tools run into the processing region in the same cycle, wherein this cycle and the synchronisation is advantageously assumed by a device which feeds the objects. Thereby, it is also possible to accommodate cycle fluctuations of this feeding device. Moreover, it is also possible to provide sensors for the control of the drives, the sensors recognising objects to be processed or their edges or corresponding markings on the material web to be processed, and producing control signals from this, for the drive of the tools. In this manner, it becomes possible to process objects with different lengths and/or different distances to one another, or to machine a material web at different distances intervals, in the same process.

The device according to the invention may be applied for example for the already initially mentioned transverse welding and, as the case may be, for the severing of a film web, in which inserted printed products arranged one after the other are continuously conveyed. For this application, the tools are designed as welding bars in a way and manner which is known per se. Thereby, a further device according to the invention may be provided on the opposite side of the film web, thus a revolving path with synchronously driven counter-tools, or a conveyor surface (e.g. conveyor belt) which supports the film web and the objects in a suitable manner. It is also possible to provide devices which are arranged separately from one another, for the transverse welding and the severing. If the material enveloping the objects can not be welded (e.g. paper), the tools are not designed as welding bars but, for example, as embossing means, which emboss a pattern to the layers of the enveloping material and connect these layers to one another, or as heating means and pressing means, which activate an adhesive which has been previously deposited on the enveloping material web and which bonds the layers of the enveloping material.

The device according to the invention may, however, also be used for completely different processing, for example for cutting the edges (e.g. leading edges) of the objects which are conveyed one after another, said edges being aligned transversely to the conveyor direction (tools are designed as cutting edges and a cutting movement is superimposed on the revolving movement), for depositing additional elements onto the objects (tools are designed as deposition means and pressing means) or for printing the objects (tools are designed as printer heads). The mentioned applications only represent a small fraction of the conceivable applications of the device according to the invention, and are in no way to limit the invention.

As may be deduced from the above paragraphs, the tools are designed very differently depending on the application of the device according to the invention. In many cases, for example also in the case of tools designed as welding bars and corresponding counter-tools, it is advantageous for the tools to carry out movements which are aligned perpendicularly to the objects to be processed or to the material web, not only during the processing, but also directly prior to this and thereafter, relative to objects to be processed or the material path. For this, it is necessary to arrange the tool pivotable relative to the revolving path in a way and manner known per se and to control the pivoting movement accordingly. Further additional movements of the tools relative to the revolving path are likewise necessary for the processing, as the case may be, and may be realised in a way and manner known per se.

BRIEF DESCRIPTION OF THE DRAWINGS

Exemplary embodiments of the device according to the invention are described in detail in combination with the following figures. Thereby, there are shown in.

DETAILED DESCRIPTION OF THE INVENTION

Figure 1A:
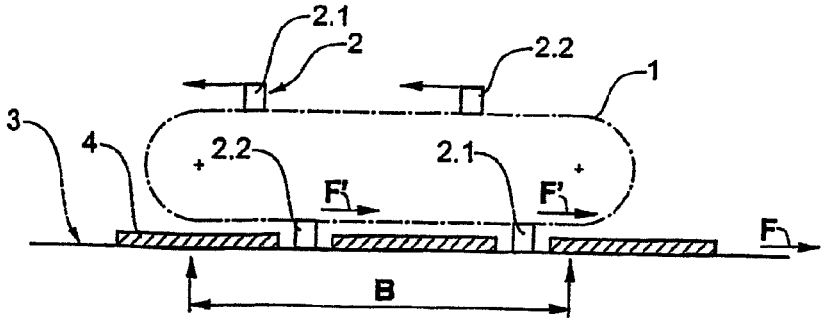
FIGS. 1A to 1C very schematically represent, consecutive phases in operation of a first exemplary embodiment of the device according to the invention, which comprises a revolving path and four tools which are coupled on two drives which are independent of one another.
Figure 1B:
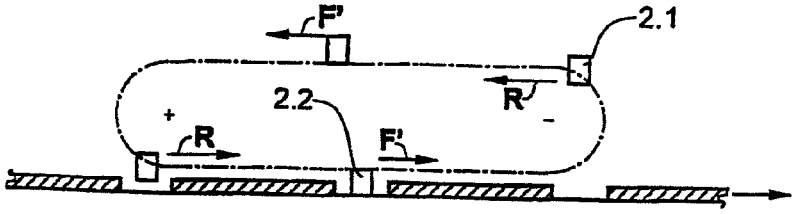
Figure 1C:
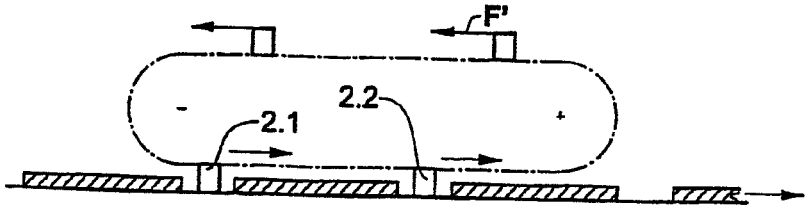

FIGS. 1A to 1C show consecutive phases of operation of a first, exemplary device according to the invention. The device comprises a revolving path 1 (indicated by a dot-dashed line), on which four identical tools 2 revolve. The revolving path 1 is arranged, for example, above a conveyor surface 3 (e.g. conveyor belt) on which flat objects 4 which are inserted into a quasi endless film web (not shown), are conveyed continuously one after another and distanced to one another. The film web is to be welded and, as the case may be, severed, at the distance intervals between the objects 4 with the help of the tools. The revolving path comprises a processing region B in which it runs essentially parallel to the conveyor direction, and return region, on which the tools 2 after a processing, are moved back again to the starting point for a further processing. Of the four tools 2, the two tools indicated at 2.1 are firmly coupled to the first drive, and those tools indicated at 2.2 are coupled to a second drive which is independent of the first drive. The drives are not represented.

In the phase represented in FIG. 1A, two tools (in each case of one of the groups 2.1 and 2.2) are located in the processing region B and are moved at a processing speed F' which is adapted to the conveyor speed F, which means that both drives operate at the processing speed F' and also the other two tools which are located in the return region, move at the processing speed F'. In the phase represented in FIG. 1B, a tool of the group 2.2 is located in the processing region B, which means both tools of the group 2.2 are driven at the processing speed F'. The tool of the group 2.2 which was still in the processing region in FIG. 1A, has left this and together with the other tool of the group 2.1 is moved with a return speed R which is independent of the processing speed F'. In this phase, the distances between the tools of both groups change.

In the phase represented in FIG. 1C, again all tools are driven at the processing speed F'.

The two drives are controlled in a manner such that the tools run into the processing region synchronously with, and equally cycled as the objects to be processed. By way of adapting the tool movement, due to the independence of the two drives, it is also possible to react to irregularities in the feed which are detected, for example, by sensor means, also in a rapid manner, and in particular when a tool is already underway in the processing region.

The processing speed F' and the return speed R are to be set depending on the length (extension in the conveyor direction F) of the objects 4 (including the distance between the objects) and depending on the conveyor speed F. In the represented case, the processing speed F' is equally large as the conveyor speed F, and the return speed R is greater than the processing speed F', since the length of the objects is smaller than a quarter of the revolving path. If the objects are equally long as a quarter of the revolving path, the return speed R is equally large as the conveyor speed. If the objects are longer than a quarter of the revolving path, then the return speed R may be smaller than the processing speed F', or it may be equally large and the tools of each group may be stopped for a pause in an operating phase, in which no tool of the group is in the processing region B.

One device, as is represented schematically in FIG. 1, is realised for example with two chain drives or belt drives whose speeds are independent of one another, wherein each second one of the tools is firmly coupled to each of the drives. As the case may be, it is advantageous to pivotably couple the tools to the drive in a way and manner known per se, and in a manner such that their pivot position may be adapted to the objects to be processed or material web, independently of a local orientation of the revolving path.

Figure 2:
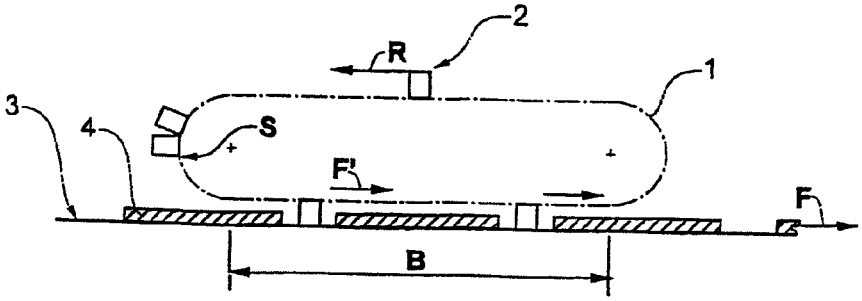
FIG. 2 a further exemplary embodiment of the device according to the invention, in which five tools revolve on the revolving path, which may be coupled to a drive and decoupled from this, independently of one another, FIGS. 3 to 5 three further, likewise very schematically represented embodiments of the device according to the invention, which may function according to the principle represented in FIG. 1, or according to the principle represented in FIG. 2.

FIG. 2, in the same, very schematic way and manner as FIG. 1, shows a further exemplary embodiment of the device according to the invention. The same elements are indicated with the same reference numerals. The device again comprises a revolving path on which five tools 2 revolve. Two drives (not shown) are provided along the revolving path: a first drive which conveys tools 2 coupled thereto at a processing speed F' adapted to the conveyor speed F at least through the processing region B, and a second drive which conveys tools 2 coupled thereto at a return speed R from the exit of the processing region B back again to its entry. A stop means S or another control element is provided at the entry of the processing means B, and brakes or stops the led-back tools and by way of this completely or partly decouples them from the second drive and optionally buffers them, and which, for each processing step, releases in each case the frontmost tool in the buffer, into the processing region, which means couples it to the first drive. The braking may also be effected by way of control of the second drive.

Evidently, one may process different lengths of objects (including distance between the objects) with the device represented in FIG. 2, wherein only the control means needs to be set, and a change of the return speed R is rendered superfluous. Evidently, the control means may release the tools in a cycled manner, which means adapted to the conveyor cycle of the objects to be processed, or also in a manner controlled by sensor, whenever an object or processing location is detected.

Of course, it is also possible to provide the device represented in FIG. 1 with only one drive, in a manner such that the return speed R is equally large as the processing speed F'. Correspondingly many tools are to be provided for this, so one may process very small object lengths.

A drive which is suitable for the device according to FIG. 2 is described for example in the publication EP-1232974 (or U.S. Pat. No. 6,607,073). Thereby, it is the case of a drive based on the eddy current principle, on which the tools may be coupled and decoupled again by way of a simple mechanical abutment which stops them and releases them again. It is also conceivable to use a chain drive, in particular if only one drive is provided (processing speed F' is equal to the return speed R), to which chain drive the tools may be selectively coupled. Such drives are described, for example, in the publications CH-618398 (or U.S. Pat. No. 4,201,286), EP-276409 (or U.S. Pat. No. 4,892,186) or EP-309702 (or U.S. Pat. No. 4,887,809).

Figure 3:
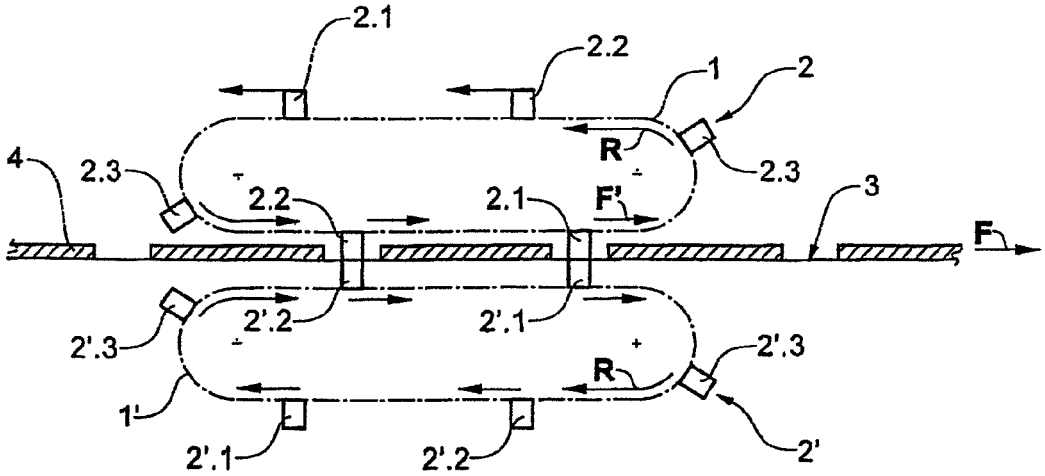
Figure 4:
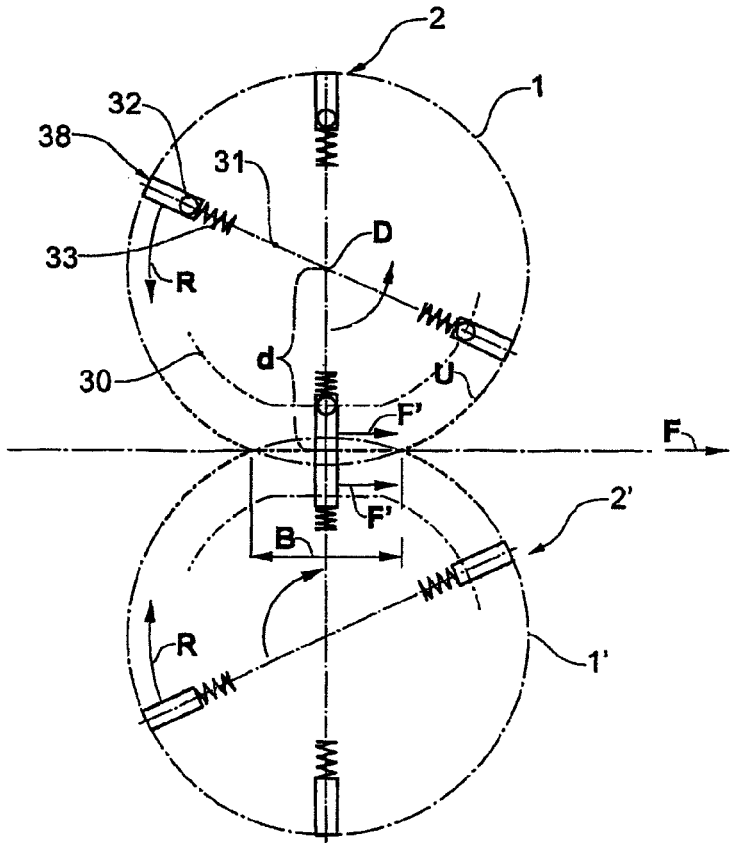
Figure 5:
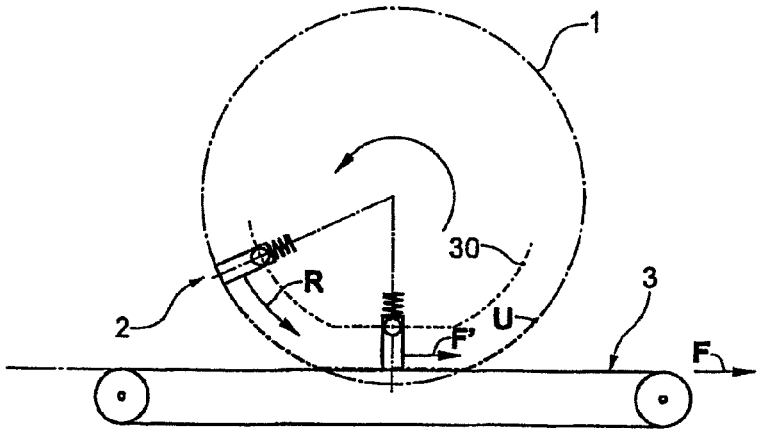

FIGS. 3 to 5, in the same, very schematic manner as FIG. 1, show further embodiments of the device according to the invention. These differ from the devices according to FIGS. 1 and 2, in particular by the shape of the revolving path 1, by the number of tools 2 revolving in the revolving path and/or by the design of the counter-tools. In the represented cases, all tools are represented as if they were driven in groups, in each case by one drive (principle according to FIG. 1). Of course however, the tools of all embodiments may also be driven according to the principle represented in FIG. 2.

FIG. 3 shows an arrangement of two devices according to the invention, wherein the first device (revolving path 1 and tools 2) is arranged above the objects 4 to be processed or over the material web, and the second device (revolving path 1' and counter-tools 2') below it. The objects 4 or the material web are conveyed, for example, on a conveyor surface 3 (e.g. conveyor belt) between the synchronously driven tools 2 and counter-tools 2', wherein the counter-tools 2' support the conveyor surface for the processing. It is also possible to do away with the conveyor surface 3 and to only convey the material web (with objects 4 as the case may be) between the tools 2 and counter-tools 2', if a sufficiently stable material web is processed and the processing does not include a severing of the material web.

Of the tools 2 as well as counter-tools 2', six revolve in groups 2.1, 2.2 and 2.3 and 2'.1, 2'.2 and 2'3 which in each case are driven on one of in each case three drives (not shown) which are independent of one another. In the operating phase represented in FIG. 3, the groups 2.1, 2.2, 2'.1 and 2'.2 move at the processing speed F', whilst the groups 2.3 and 2'.3 move at the return speed R.

FIG. 4 shows a further arrangement of two devices according to the invention with cooperating tools 2 and counter-tools 2'. The two revolving paths 1 and 1' are circular, wherein one ensures by way of a resilient mounting of the tools 2 and/or the counter-tools 2', that the revolving paths U of the distal tool ends cooperating with the material web (also called processing element 38 hereinafter) is flattened in the processing region B, and are aligned parallel to the conveyor direction by way of this. The two groups of tools and counter-tools, for example, are arranged in each case on a rotating wheel (not represented).

Instead of a purely resilient mounting of the tools 2 along a radially aligned guide rail 31, a guide cam 30 (shown dashed) cooperating with the tools 2, may be present in at least a part of the revolving path 1, with which guide cam the distance d of the tools to the rotation centre D may be set. The tools 2 which may be moved in the radial direction along the guide rail 31 or the guide elements 32 which are attached on the tools 2, in this case are cushioned against the guide cam 30 with a spring 33. The path of any point on the guide rails 31 is to be seen as a revolving path 1, and here by way of example, the path of the distal end of the guide rail 31 is drawn in. Without the effect of the guide cam 30, the tools 2 are pressed into their radially outer lying position (distance d corresponds to the radius of the revolving path 1); the distance is reduced in a controlled manner under the effect of the guide cam 30.

In the processing region B, the tools 2 are pulled back towards the rotation centre against spring force by the cam 30. As outlined above, the path U of the distal tool ends in comparison to a purely circular path is flattened by the effect of the cam 30. With this, only an exactly meterable, constant force is exerted onto the conveyor surface 3 or onto the counter-tools 2'. The tool ends are always orientated in the radial direction.

The spring system may also be done away with if the tools are guided along the complete revolving path 1.

The flattening of the movement path with respect to a circular path by way of a cam-controlled movement of the tools may also be applied to tools, which are not driven independently of one another, e.g. to devices with only one tool which is moved along a circular path. The counter-device may be designed in an analogous manner (not shown here). In particular, the counter-tools 2' may be controlled by guide cams, as with the tools 2.

FIG. 5 shows a device according to the invention with a circular revolving path 1 and two tools 2, wherein the tools cooperate with a conveyor surface and the tools are resiliently mounted. Each of the two tools is driven by its own drive (not shown Here too, a cam 30 may be present, which ensures the flattening of the path U of the distal tool ends with respect to their actual movement path 1. Only a slight, well-defined force is exerted onto the conveyor rest 3 by way of this. The path of the tools 2 may be set in an optimal manner relative to the conveyor surface 3.

Figure 6:
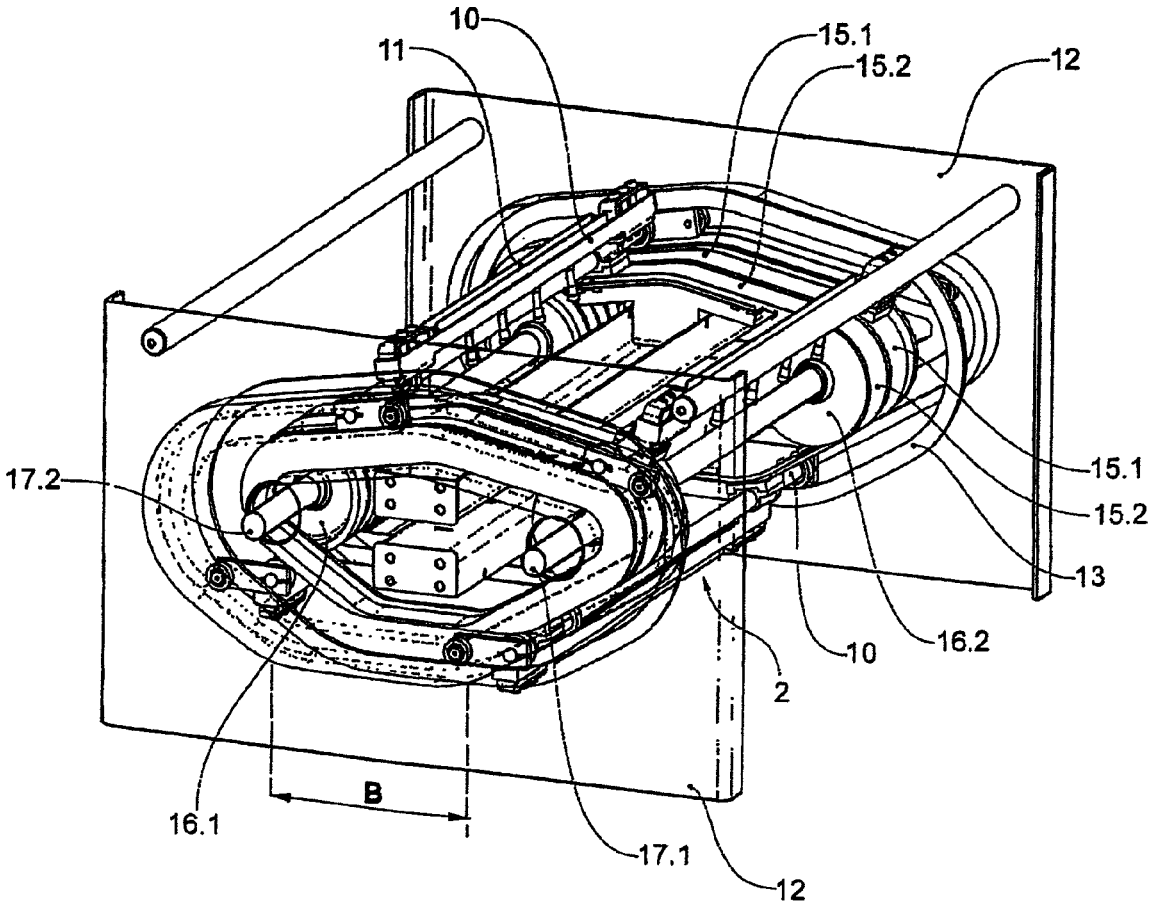
FIG. 6 a three-dimensional representation of a preferred embodiment of the device according to the invention (principle according to FIG. 1) with four revolving tools, which are designed as welding bars.

FIG. 6, in detail, shows a preferred embodiment of the device according to the invention. This corresponds essentially to the schematically represented device of FIG. 1. The four provided tools 2 comprise carrier beams 10 and welding bars 11 which are fastened on the carrier beams 10, wherein the carrier beams 10 and the welding bars 11 extend between two walls 12. Rails 13 are arranged at sides of the two walls 12 which are opposite one another, and these rails define the revolving path of the tools 2, and in which the carrier beams 10 are guided in a rotatable or at least pivotable manner, and in a manner such that the position of the welding bar relative to the revolving path may be changed by way of a stationary cam during the tool movement along the revolving path. Each second carrier beam is coupled to a first belt drive. The first belt drive comprises two toothed belts 15.1, on which the ends of the carrier beam 10 are fastened and which run in each case via two toothed wheels 16.1 are arranged coaxially in pairs, wherein one pair of coaxial toothed wheels is driven via a first drive shaft 17.1. The other two carrier beams are coupled to a second belt drive, which means they are likewise fastened on two toothed belts 15.2, which likewise run via in each case two toothed wheels 16.2 arranged coaxially with the toothed wheels 16.1 of the first belt drive and of which two are driven via a second drive shaft 17.2. The toothed belts 15.1 and 15.2 run in pairs next to one another, guided by way of further guide means, additionally to the toothed wheels, on a revolving path which is adapted to the revolving path of the carrier beam 10. The revolving path of the welding bar 11 is not only determined by the revolving path of the carrier beam 10, but additionally by the pivot movement of the carrier beam 10.

The device represented in FIG. 6 is distinguished not only by its versatility with regard to the adaptation to the format of the object to be packaged, but also by its quiet running, in particular when compared to devices which comprise crank gears or device parts moving to and fro.

Figure 7:
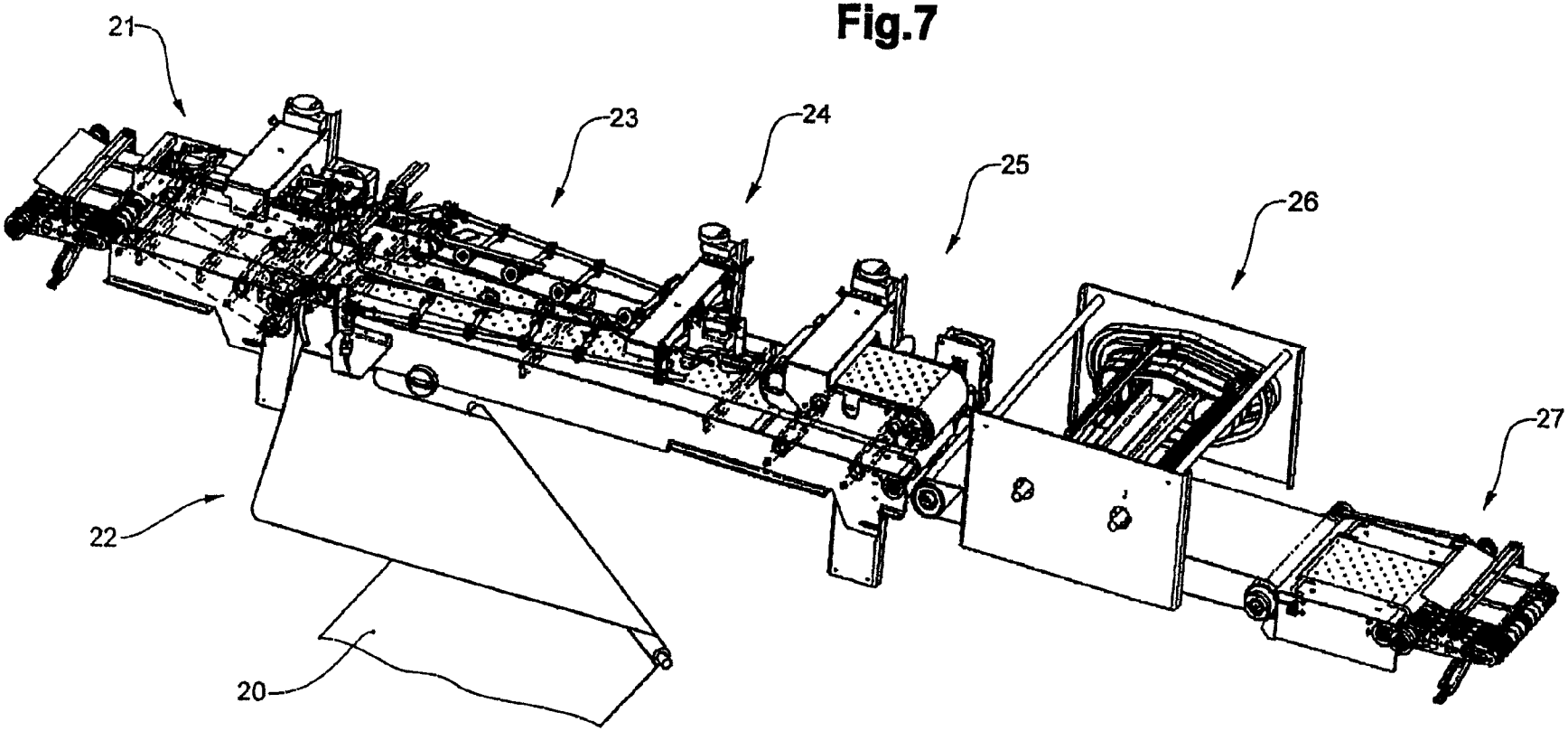
FIG. 7 the device according to FIG. 6, applied in an installation for packaging flat objects which are conveyed one after another in a continuous manner, with a quasi endless film web.

FIG. 7 shows an installation of the device according to FIG. 6. This is applied in an installation for packaging flat objects such as printed products for example, by way of a quasi endless film web 20, in order to transversely weld and as the case may be, sever the film web 20 at the distances between the objects, wherein this film web has been previously applied around the objects (not shown) which are conveyed in a continuous manner behind one another and distanced to one another.

The installation comprises the installation regions which are known per se and which serve the following functions: feeding the flat objects (device region (21), feeding the quasi endless film web 20 (device region 22), enveloping the film web 20 around the row of flat objects (device region 23), longitudinal welding of the film web 20 (device region 24), pressing the row of flat objects enveloped by the film web (device region 25), transversely welding and severing the film web 20 between the objects (device region 26) and transporting away the individually packaged, flat objects (device region 27).

Figure 8:
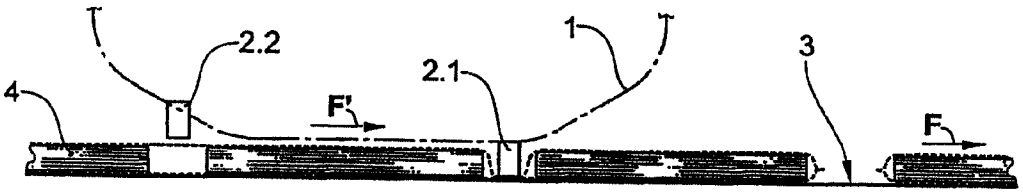
FIG. 8 the processing region of the device according to FIG. 6, in a larger scale.

FIG. 8 in a somewhat larger scale shows the processing region of the device according to FIG. 6. It is evident from FIG. 8, that the processing region in which the tools effectively act on the film web and for this purpose are conveyed at the same speed as the film web, is flanked by a run-in region, in which the tools approach the film web and in particular are moved in between consecutive objects, and a run-out region, in which the tools move away from the film web and in particular are moved out from between the consecutive objects. It is advantageous in the run-in region as well as the run-out region, for the welding bars to be aligned perpendicular to the film web and to be moved towards this and away from this in a manner which is as perpendicular as possible (no or at the most a small relative speed between the tool and the film web in the conveyor direction). This is realised by way of the carrier beam in the run-in region and run-out region in the conveyor path being pivoted in a manner such that the welding bar is aligned perpendicularly to the film web. Advantageously moreover, the revolving path 1 in the run-in region and run-out region is essentially straight-lined, and the speed of the tools in its adaptation to the gradient of the revolving path, is somewhat larger than the processing speed F'. It is possible by way of the mentioned adaptations, to extend the welding bar into the distances between the objects and retract them again, in a very precise manner, and in a manner such that these distances may be limited to a minimum, even with relatively thick objects, which with large piece numbers entails a significant saving of film.

Figure 9:
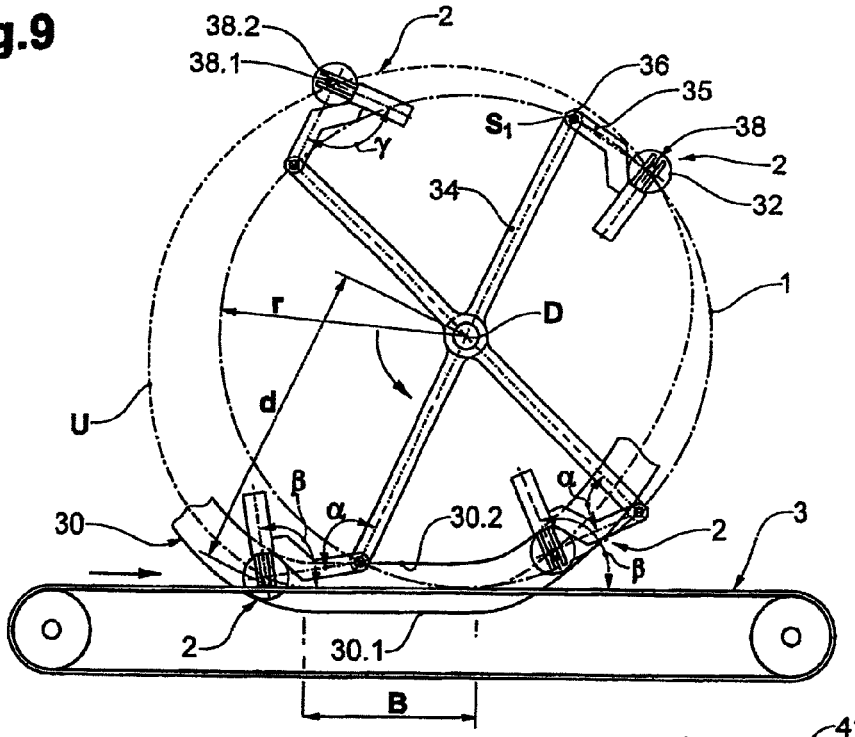
FIG. 9 one example for a device according to the invention with tools which are articulated on a rotatable, rigid body.

FIG. 9 shows an example of a device according to the invention with two carrier elements 34 in the form of spokes which may be rotated about a rotation centre D. In each case, a tool 2 is attached at the distal ends of the carrier elements 34. The two spokes 34 may be driven independently of one another as with the example of FIG. 4, so that the angle between them and thus also the distance of the tools may be varied. With applications with which a constant angle or the distance of the tools is sufficient, the carrier elements 34 may also be coupled to one another in a rigid manner and/or only one drive may be used. Likewise, also only a single tool 2 may be present.

The tools 2 here comprise a processing element 38, which in the application case cooperates with the object to be processed or the material web. The processing element 38, for example, comprises a welding element 38.1 and a holding-down means 38.2. A first lever end 36 of a lever 35 is pivotably connected to the distal end region of the carrier element 34 about a pivot axis S1. The processing element 38 is arranged on this lever 35 at a distance to the pivot axis S1. The angle $\alpha$ between the lever 35 or its lever axis and the carrier element 34 is variable. The angle $\gamma$ between the lever 35 and the acting direction of the processing element 38, which is defined by the orientation of the welding element 38.1 and the holding-down means 38.2, is constant at approx. 90° in this example, but may be varied in a further development of the device (cf. FIG. 10).

The levers 35 comprise a guide element 32, here in the form of a runner roller, which cooperates with a stationary guide cam 30 in the form of a revolving groove. The pivot position of the lever 35 relative to the carrier element 34 and thus, the pivot position of the tools 2 relative to the circular revolving path 1 may be set by way of this. Thus, the distance d of the processing elements 38 to the rotation centre may be set by way of this. The guide cam 30 here is shaped such that the distance d is always larger than or equal to the radius r of the revolving path 1, wherein the distance d in the processing region B changes such that a path U with an approximately straight portion is produced. Thus, one also succeeds in creating an angle $\beta$ of here approx. 90 to 100° between the conveyor surface 3 and the processing element 38, which is at least regionally constant in the processing region B.

The guide cam 30 in the form of a revolving groove here comprises two guide surfaces 30.1, 30.2 which are distanced to one another and which guide the guide element 32 on both sides and, thus, set the distance d and simultaneously the orientation of the processing element in the space or the angle $\beta$ relative to the conveyor surface. The guide cam 30 has guide surfaces 30.1, 30.2 running in a straight manner, parallel to the conveyor surface 3, in the processing region B, for creating a path U with a straight portion. The respective other guide surface may be done away with, in the case that the lever 35 is biased towards one of the guide surfaces 30.1, 30.2.

The levers 35 and, thus, the processing elements 38 are pulled behind the carrier elements 34 in the rotation direction in the manner of a cam lever. Their weight force is accommodated in the processing region B at least partly by the cam 30. The remaining force serves for pressing the processing elements 38 onto the conveyor surface 3. In the shown example, the distance between the distal ends of the holding-down means 38.2 and the welding element 38.1 is varied by way of this, so that a material web 20 may be welded.

Figure 10:
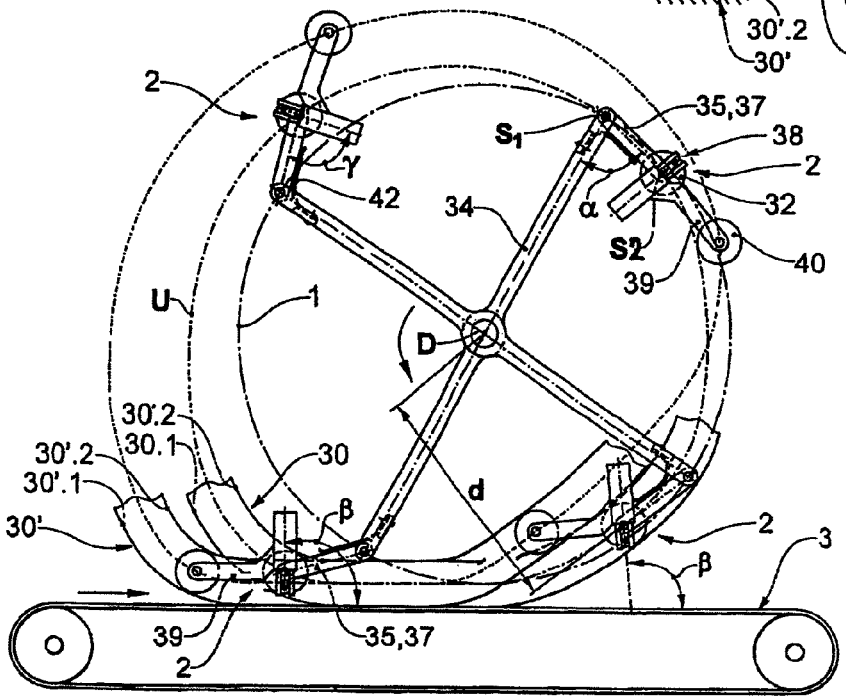
FIG. 10 a further development of the example of FIG. 9, with which the tools are movable with two degrees of freedom with respect to the rigid body.

FIG. 10 shows a further development of the device represented in FIG. 9, with which the distance d of the processing element 38 to the rotation centre D, and the orientation of the processing element 38 in space, i.e. the angle $\beta$ relative to the conveyor surface 3, may be set independently of one another. By way of this, in comparison to the total length of the path U of the processing elements 38, one may produce longer sections in which the path U runs parallel to the conveyor surface 3, and the processing elements 38 have a defined orientation in space.

Figure 11:
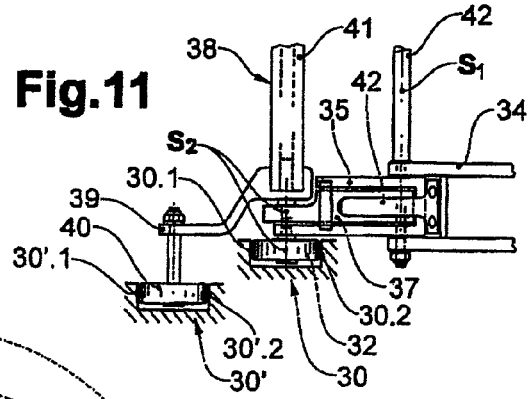
FIG. 11 a detailed view of the device of FIG. 10, for representing the guide elements.

The processing element 38 as with FIG. 9, is connected to the carrier elements 34 in a pivotable manner. As is shown in FIG. 11, the lever connecting the processing element 38 and the carrier element 34 is designed as a double lever and comprises a U-shaped, first lever part 35 and a second lever part 37 which is arranged therein, mounted in a resilient manner relative to the first lever part 35. The double lever 35/37 as a whole may be pivoted about the pivot axis S1, wherein the two lever parts 35, 37 may be deflected relative to one another. The processing element 38 is located on the second lever part 37, and a control element 32 cooperating with a first guide cam 30 is arranged on the first lever part 35. As described above with reference to FIG. 9, the distance d is set by way of varying the angle α between the first lever 35/37 and the carrier element 34 with the first cam 30. The processing element 38 however is not rigid, but is connected to the first lever 35 in a pivotable manner about the second pivot axis S2. The angle γ between the first lever 35/37 and the processing element 39 may therefore be set independently of the angle α. A second guide cam 30' serves for this, and cooperates with a further guide element 40, here likewise in the form of a guide roller. The further guide element 40 is coupled via a second lever 39 to the processing element 38. It is located at a distance to the further pivot axis S2. Basically, the guide elements 32, 40 may be located at any position on the first or second lever 35/37, as long as a distance to the respective pivot axis S1 and S2 is maintained. The processing element 38 may likewise be located at any location on the second lever 39.

The processing element 38 may be displaced relative to the first guide element 32 by the first lever with a first lever part 35 and a second lever part 37, which is arranged resiliently thereto, in order for example with particularly thick objects or a backlog of objects, to back away from the path defined by the first cam 30. In this case, the pivot axis S1, which in the usual case is aligned to the axis of the control element 32, displaces with respect to this axis. The flexibility and reliability of the device is increased by way of this. Such a measure could also be provided with the device according to FIG. 9.

The guide cams 30, 30' here in each case again comprise two guide surfaces 30.1, 30.2 and 30'.1, 30'.2 which are distanced to one another in the radial direction. The first levers 35 are biased towards the radially outer lying guide surface 30.1 of the first guide cam 30 with a spring 42. So that the paths of the respective guide elements 32, 40 may approach one another or even cross one another, these movement paths lie in different planes which run parallel to the plane of the drawing. This is represented in FIG. 11.

With the further formation of a device with a processing element which is articulated on a rotating carrier element via two pivotable levers, which is shown in FIGS. 10 and 11, one succeeds in creating a straight path of the processing elements as well as a freely selectable orientation in space which is constant, at least in regions, despite a purely rotating movement of the carrier elements about a rotation axis.

The arrangement shown in FIGS. 9 and 10 may be designed mirror-symmetrically to a plane running parallel to the plane of the drawing, for stabilising the whole device. The carrier elements 34 are located, for example, mirror-symmetrically on opposite sides of the conveyor rest 3. The processing elements 38 may be arranged on elongate beams 41 which are perpendicular to the drawing plane and which are mounted in each case on a carrier element 34 at their outer ends and here define the second pivot axis S2 for example (cf. FIG. 11). Stabilising members 42 may likewise be arranged along the first pivot axes S1.

Figure 12:
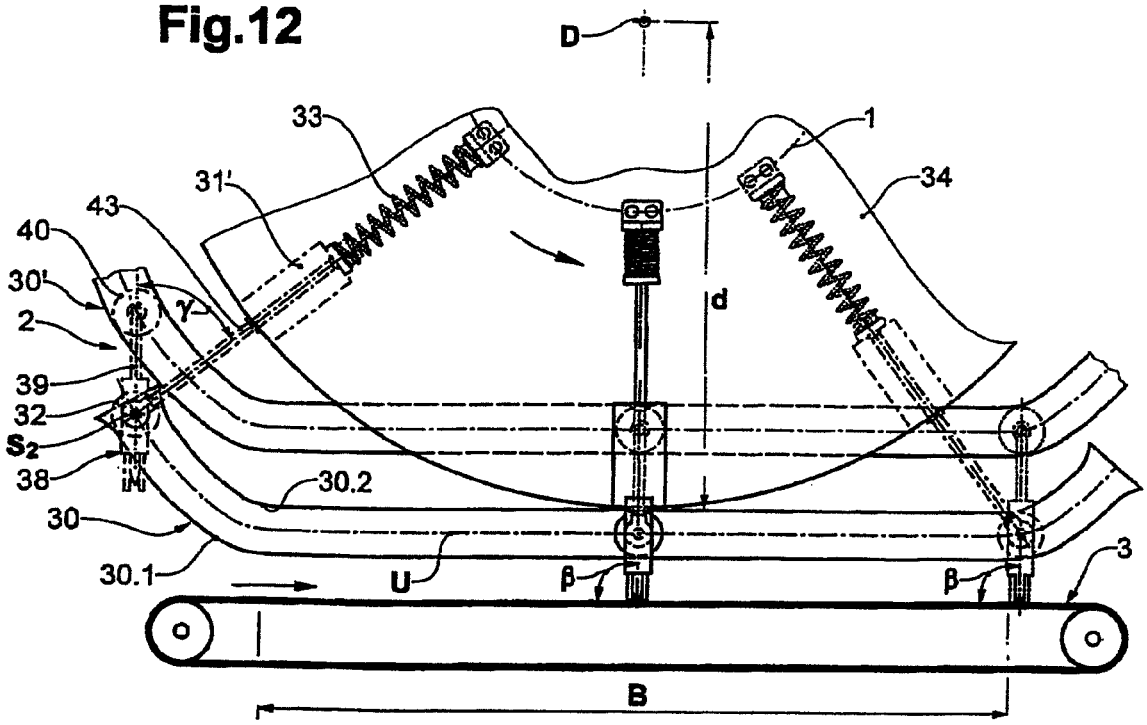
FIG. 12 a further development of the example of FIG. 4, with which the tools are movable with two degrees of freedom.

FIG. 12 shows a variant of the device represented in FIG. 4, with which additionally to the variation of the distance d of the processing element 38 to the rotation centre D by way of the first guide cam 30, the orientation of the processing element 38 is adapted by way of a second guide cam 30'. The processing element 38 therefore, as with the example of FIG. 10, has two degrees of freedom, so that despite a purely rotational drive, one may produce a desired path U and a predefined orientation with a greater precision.

As with FIG. 4, a tool 2 is attached on a rotatable carrier element 34, here in the form of a wheel, and is displaceable in the radial direction, i.e. perpendicularly to the rotation axis. One position in the processing region is represented by unbroken lines; two further positions before entry into the processing region and at the end of this are drawn in a dashed manner. A punch 43 for this is movable in a guide sleeve 31' and is biased outwards with a spring 33. A guide element 32 in the form of a runner roller which is led by the first cam 30 at least in the processing region B, is located at the distal end of the punch 43. The processing element 38 is pivotably connected about a pivot axis S2 to the distal punch end. The distance d is adapted by way of the guide element 32 sliding along the first guide cam 30 during the rotation of the carrier element 34. The first guide cam 30 here is shaped such that a path U of the processing elements 38 is produced, which runs parallel to the conveyor surface in the processing region B. The guide surfaces 30.1, 30.2 of the first guide cam 30 for this likewise run parallel to the conveyor surface 3, at least in regions. Since the processing elements 38 are biased outwards, it is sufficient for the first guide cam 30 to only be located in the part region of the revolving path 1 which corresponds to the processing region.

The processing element 38 is connected via a lever 39 to a second guide element 40, likewise in the form of a running roller. The angle γ between the processing element 38 and the punch 43 is adapted by way of the second guide element 40 sliding along the second guide cam 30' during the rotation of the carrier element 34. Here, the second guide cam 30' is shaped such that the orientation of the processing element 38 in space or relative to the conveyor surface 3 remains the same, at least in the processing region B. With this, a constant angle β here of 90°, i.e. perpendicular action on the material web, may be realised in the processing region. Likewise, one succeeds in lowering the processing element onto the material web in this orientation.

As with the previously outlined embodiments, the first guide cam 30 contributes to the metering of the force acting on the conveyor surface 3. One or more tools may be present. With several tools, these may be driven in a synchronous manner or at different speeds.

Figure 13:
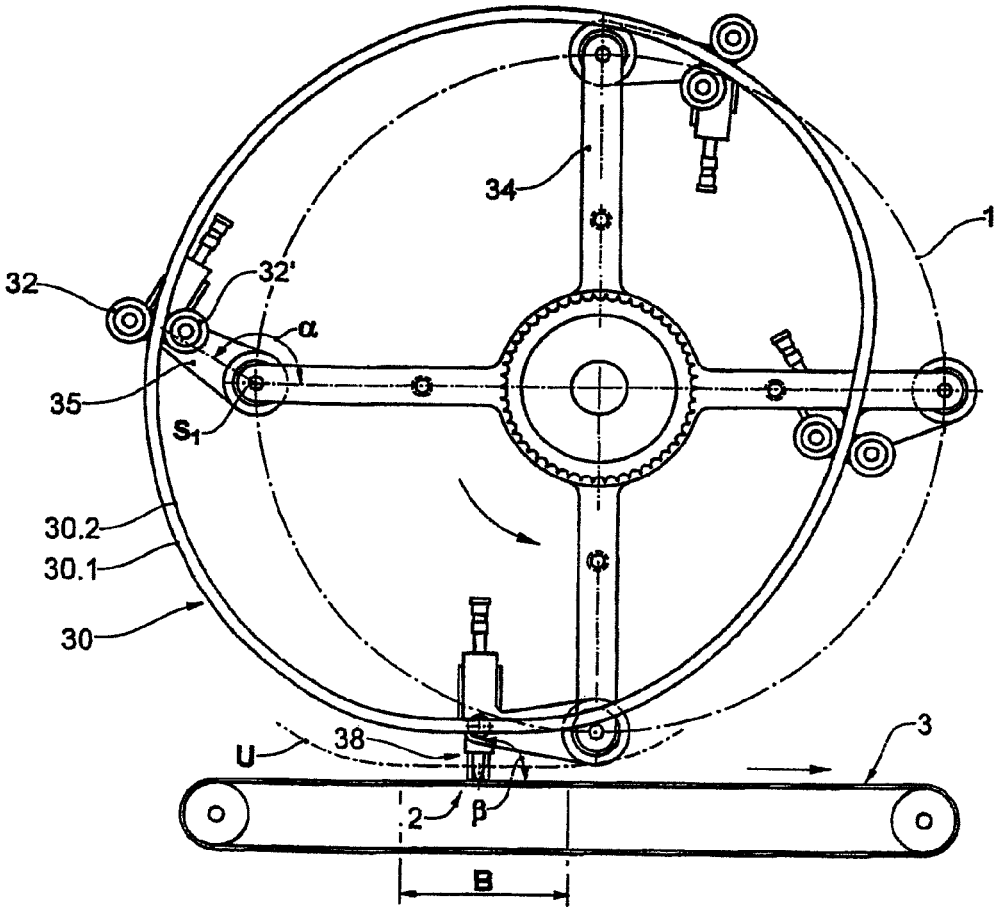
FIG. 13 one variant of the device of FIG. 9.

FIG. 13 shows a further example of the invention with a basic construction which corresponds to FIG. 9. In each case, a tool 2 is pivotably attached via a lever 35 trailing in the peripheral direction, to the distal ends of four spoke-like carrier elements 34. The pivot position, i.e. the angle α between the lever 35 and the carrier element 34, is set with a guide cam 30. The guide cam 30 here is not in the form of a groove as with FIG. 9, but has the shape of a closed ring with two revolving guide surfaces 30.1, 30.2 which in each case are orientated to the outside. These guide surfaces 30.1, 30.2 are touched by a pair of guide elements 32, 32'. One may produce a path U of the processing elements which at least in regions runs parallel to the conveyor surface 3 by way of the flattening of the guide cam 30.

In contrast to the device according to FIG. 4, where the processing elements 38 always point in the radial direction, with this variant, one succeeds in the orientation of the processing element 38 relative to the conveyor surface 3 being approximately constant at least in the processing region, on account of the articulation of the processing element 38 onto the carrier element 34 via the lever 35. The part region of the path U, in which it runs parallel to the conveyor surface 3 and in which the angle β does not essentially change, however compared to the total length of the path U, is shorter than e.g. with FIGS. 10 and 12.

As with FIGS. 9 and 10, the angle between in each case a spoke pair may be kept constant or be varied by an additional drive, depending on the demands.

The invention claimed is:

1. A device for processing flat objects which are conveyed in a conveyor direction one after another in a continuous manner at a conveyor speed, or a continuously conveyed, material web, said device comprising:

at least one tool driven in a revolving manner on a revolving path, a drive unit for moving the at least one tool on the revolving path, a control unit for controlling the drive unit, at least one cam, stationary with respect to the revolving path, that is adapted to change the direction of the tool relative to the revolving path during the tool movement along the revolving path, wherein the revolving path comprises a processing region that is aligned parallel to the conveyor direction of the objects or material web, wherein the objects or material web may be processed by way of the at least one tool moved through the processing region, and wherein the at least one tool may be moved through the processing region by the drive unit at a processing speed adapted to the conveyor speed, and wherein the at least one tool is pivotable relative to the revolving path in a controlled manner, in a manner such that its pivot position is adaptable in a controlled manner to the objects to be processed or to the material web, independently of an orientation of the revolving path.

2. A device according to claim 1, wherein the drive unit is designed in order to move groups of tools or individual tools on the revolving path, independently of other groups of tools or independently of other individual tools, in a manner such that different tools may be moved on the revolving path simultaneously at different speeds.

3. A device according to claim 1, further comprising at least one cam, stationary with respect to the revolving path, that is adapted to change the position of the tool relative to the revolving path during the tool movement along the revolving path.

4. A device according to claim 3, wherein the cam limits the force exerted by the tool onto the objects to be processed or onto the material web, keeping this force constant.

5. A device according to claim 3, wherein the revolving path is arcuate at least in the processing region, and that the cam is shaped in a manner such that the tools are moved along a straight path, despite the arcuate revolving path in the processing region.

6. A device according to claim 4, wherein the tools in the processing region are movable with a constant orientation relative to the objects to be processed or to the material web.

7. A device according to claim 1, further comprising at least one carrier element rotatable about a rotation centre, wherein the tool(s) comprise a first lever as well as a processing element cooperating with the objects or the material path, wherein the first levers are pivotally connected about a pivot axis to the at least one carrier element and comprise the processing element at a distance to the pivot axis, and wherein at least one stationary cam is present, with which the pivot position of the first levers relative to the at least one carrier element may be set at least in the processing region.

8. A device according to claim 7, wherein the tool(s) comprise a second lever, which is pivotally connected about a second pivot axis to the first lever, and wherein the orientation of the processing element relative to the revolving path and to the objects to be processed or to the material web, may be set by way of two stationary cams.

9. A device according to claim 7, further comprising at least one carrier element in the form of a wheel or a spoke rotatable about the rotation center.

10. A device according to claim 7, wherein the tool(s) comprises a welding element and a holding-down unit, which is arranged in a resilient manner relative to the welding element.

11. A device according to claim 1, further comprising at least one counter-tool, which is capable of cooperating with the at least one tool, wherein the counter-tool is revolvingly driven on a second revolving path, and wherein it is pivotable relative to the second revolving path in a controlled manner, in a manner such that its pivot position is adapted in a controlled manner to the objects to be processed or to the material web, independently of an orientation of the second revolving path.

12. A device according to claim 1, further comprising at least one counter-tool, which is capable of cooperating with at least one tool, wherein the counter-tool is formed by a conveyor rest in the form of a revolving conveyor belt.

13. A device for processing flat objects which are conveyed one after another in a continuous manner at a conveyor speed, or a continuously conveyed, material web, said device comprising:

tools driven in a revolving manner on a revolving path, a drive unit for moving the tools on the revolving path, a control unit for controlling the drive unit, at least one cam, stationary with respect to the revolving path, that is adapted to change the direction of the tools relative to the revolving path during the movement of the tools along the revolving path, wherein the revolving path comprises a processing region that is aligned parallel to a conveyor direction of the objects or material web, wherein the objects or material web may be processed by way of the tools moved through the processing region, wherein the tools may be moved by the drive unit through the processing region at a processing speed adapted to the conveyor speed, and wherein the drive unit is designed in order to move groups of tools or individual tools on the revolving path independently of other groups of tools or independently of other individual tools, in a manner such that different tools may be moved on the revolving path simultaneously at different speeds.

14. A device according to claim 13, wherein the drive unit or the control unit may be operated in an regular cycle, which is adapted to the conveying of the objects to be processed or the material web, or in a sensor-controlled manner.

15. A device according to claim 13, wherein the drive unit comprises at least two drives, wherein in each case an equal number of tools is coupled to each drive, and wherein each of the drives may be controlled in a cyclic operation, in which a tool movement at a processing speed alternates with a tool movement at a return speed which is different to the processing speed and/or with a tool standstill, wherein the cyclic operation of the at least two drives differs by a phase shift.

16. A device according to claim 15, wherein the return speed may be set.

17. A device according to claim 15, wherein the at least two drives are chain drives or belt drives, which are separate from one another.

18. A device according to claim 17, wherein four tools and two drives are provided, wherein the tools are coupled to the one or to the other drive in an alternating manner.

19. A device according to claim 13, wherein the drive unit comprises at least one drive, which is designed for a coupling and decoupling of the tools, and that the control unit is designed in order, individually, to decouple the tools from the drive or to couple them to the drive.

20. A device according to claim 19, wherein a single drive is provided, by way of which the tools may be driven in a coupled condition along the complete revolving path, at the processing speed.

21. A device according to claim 20, wherein a second drive is provided, wherein the tools are movable at the processing speed at least through the processing region by way of the first drive, and at a return speed which is different from the processing speed, along the remainder of the revolving path by way of the second drive.

22. A device according to claim 21, wherein the control unit comprises a stop which acts on tools directly in front of the processing region, the drive is designed in a manner such that tools stopped by the stop drag relative to the drive, and the stop may be controlled for a buffering of the tools and a release of individual tools into the processing region.

23. A device according to claim 13, wherein the tools are pivotable relative to the revolving path in a controlled manner.

24. A device according to claim 23, wherein the revolving path runs parallel to the conveyor direction in the processing region, and, flanking the processing region, comprises a run-in region and a run-out region, in which run-in and run-out regions the revolving path runs to the objects to be processed or material web, or runs away therefrom, and that the tools in the processing region, in the run-in region and in the run-out region, are directed perpendicularly to the objects or the material web.

25. A device according to claim 24, wherein the speed of the tools in the run-in region and run-out region is adapted to an angle between the revolving path and the conveyor direction.

26. A use of a device according to claim 13, for the transverse welding of a material web between flat objects, which are inserted into the material web one after another and distanced to one another.

27. A use according to claim 26, wherein a conveyor surface is provided as a counter-tool for the tools of the device.

28. A device according to claim 1, wherein the at least one tool that is pivotable relative to the revolving path in a controlled manner, is pivotable such that a path of active processing elements of the tool match a straight path of the objects or the material web, without a counter force exerted a conveyor surface which supports the objects or material web.

* * * * *